United States Patent [19]

Ederer et al.

[11] 4,111,163

[45] Sep. 5, 1978

[54] AIR INDUCTION SYSTEM FOR AN INTERNAL COMBUSTION ENGINE

[75] Inventors: Georg Ederer, Munich; Adolf Fischer, Haar am Jagdfeld; Paul Rosche; Helmar Troll, both of Munich; Wolfgang Wurst, Dachau; Helmut Hengl; Jiří Seidl, both of Munich, all of Fed. Rep. of Germany

[73] Assignee: Bayerische Motoren Werke AG, Munich, Fed. Rep. of Germany

[21] Appl. No.: 598,086

[22] Filed: Jul. 22, 1975

[30] Foreign Application Priority Data

Jan. 15, 1975 [DE] Fed. Rep. of Germany ..... 2501305

[51] Int. Cl.[2] ..... F02B 75/18

[52] U.S. Cl. ..... 123/52 M; 123/52 MV

[58] Field of Search ..... 123/139 AW, 52 M, 52 R, 123/52 MV

[56] References Cited

U.S. PATENT DOCUMENTS

| | | | |
|---|---|---|---|
| 1,938,252 | 12/1933 | Hamacheck | 123/52 M |
| 2,835,235 | 5/1958 | Gassmann | 123/52 M |
| 3,177,854 | 4/1965 | Garcea | 123/52 M |
| 3,916,850 | 11/1975 | Date | 123/52 M |

*Primary Examiner*—Ronald H. Lazarus

*Attorney, Agent, or Firm*—Ladas, Parry, Von Gehr, Goldsmith & Deschamps

[57] ABSTRACT

The invention provides an air induction system or manifold for a multi-cylinder internal combustion engine, which is arranged in two parts, the first having portions of the induction passages for each cylinder formed therein, and the second attached to the first to form a housing therewith in communication with each of the induction passages, at least the first part being arranged so that it may be pressure die cast in manufacture.

9 Claims, 5 Drawing Figures

AIR INDUCTION SYSTEM FOR AN INTERNAL COMBUSTION ENGINE

BACKGROUND OF THE INVENTION

In the design of an air induction system for internal combustion engines it is known, for instance by virtue of German Patent Specification No. 23 40 035, that special induction passages may be provided which connect a distributor housing with inlet ports of a cylinder head. The mounting of the induction passages on the distributor housing by means of bolts or other fixing means requires a great number of individual parts and considerable assembly time.

The invention has as an object the improvement of such an air induction system thereby alleviating the aforementioned disadvantages, simplifying the design and construction of the air induction system and reducing the number of component parts and thus the building costs and assembly time.

SUMMARY OF THE INVENTION

The invention provides an air induction system for an internal combustion engine comprising a first part, a plurality of induction passage portions formed integrally with said first part for connection to respective inlet parts of the engine, and a second part joined to said first part to form therewith a distributor housing in communication with each of said induction passage portions.

It is indeed known for parts of the induction passages to be sand-cast in one piece with a distributor housing or a part thereof as for instance disclosed in U.S. Pat. No. 2,928,564. In contrast, the advantage of the invention resides in the fact that one part of the distributor housing can be produced by pressure die casting integrally with portions of the induction passage, while the other part or parts can be produced in each case in one piece, by the pressure die casting or permanent mold casting method from light metal or synthetic plastics material so that the entire air induction system consists of parts which can be rationally produced and connected. In this respect, the internal cross-section of the induction passages widening out towards one end or both, is not only of advantage in the casting of the part by permitting easy removal from the casting die, but is at the same time also advantageous to the operation of the air induction system because the internal cross-sectional pattern and thus the flow conditions therein can be tuned to the requirements of the particular type of internal combustion engine involved.

The pivoting together of those ends of the curved portions which discharge into the distributor housing makes it possible for the distributor housing to be tapered at least to one side, corresponding to the pivoted position of the portions, so that its design is particularly space-saving. In its longitudinal section, then, the distributor housing approximates the form of a triangle and can thus be better adapted to motor vehicles having bonnets which extend forwards in an obliquely downwards direction. If the curved portions are pivoted from both sides toward a middle transverse plane of the distributor housing, then this latter becomes approximately trapezoidal in cross-section.

BRIEF DESCRIPTION OF THE DRAWINGS

In order to promote a fuller understanding of the invention some embodiments will now be described, by way of example only, with reference to the accompanying drawings in which.

DESCRIPTION OF PREFERRED EMBODIMENTS

Figure 1:
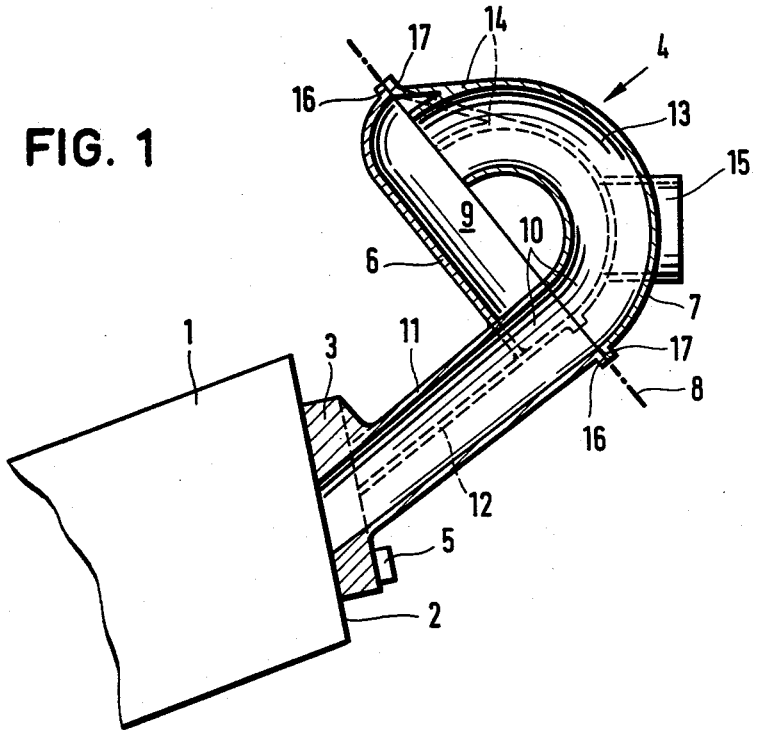
FIG. 1 shows the cross-section of a first embodiment of an air induction system according to the invention, having a two-part distributor housing and portions of induction manifolds connected in one piece each with one part of the distributor housing.

As shown in FIG. 1, in a first embodiment a two-part air induction system 4 is mounted through fixing flanges 3, by means of screws 5, on the cylinder head of an internal combustion engine 1, on the long face 2 thereof, being formed with mouths of inlet ports (not shown). The air induction system 4 includes a first part 6 and a second part 7 which are joined to each other along a plane 8 so that they form a distributor housing 9.

Formed in the trough-shaped first part 6, are straight portions 11 of induction passages 10 which discharge into the distributor housing 9. The individual straight portions 11 of the induction passages lie, in positions corresponding to the disposition of the inlet ports of the internal combustion engine 1, parallel to one another, being connected to one another by locks 12.

The second part 7 of the system includes further, curved portions 13 of the induction passages 10 which are connected to one another via the outer wall 14 of the second part 7. A connector 15 for connection of a air filter or carburettor (not shown), is disposed in the second part 7, in the middle of the length-wise disposition of the curved portions 13 of the induction passages.

The straight portions 11 and the further, curved portions 13 of the induction passages 10 are so disposed in the parts 6 and 7 that when they are assembled, each straight portion 11 is aligned with and abuts the associated portion 13 in the region of the plane 8. The parts 6 and 7 are provided with flanges 16, 17 respectively which enlarge the contact area in the plane 8. The faces of these flanges may be provided with the profiles to encourage an adhesive joint, particularly a roughened surface produced by a metal-cutting process in manufacture. Clip, rivet bolted and folded band connections are particularly suitable for holding the two parts 6 and 7 together.

The straight portions 11 of the induction passages 10 have an internal cross-section which diminishes in the direction towards the cylinder head of the internal combustion engine 1. In consequence, the casting can be withdrawn from the mold particularly well and, furthermore, it is possible in use to achieve an acceleration of the induced air towards the inlet valve.

Figure 2:
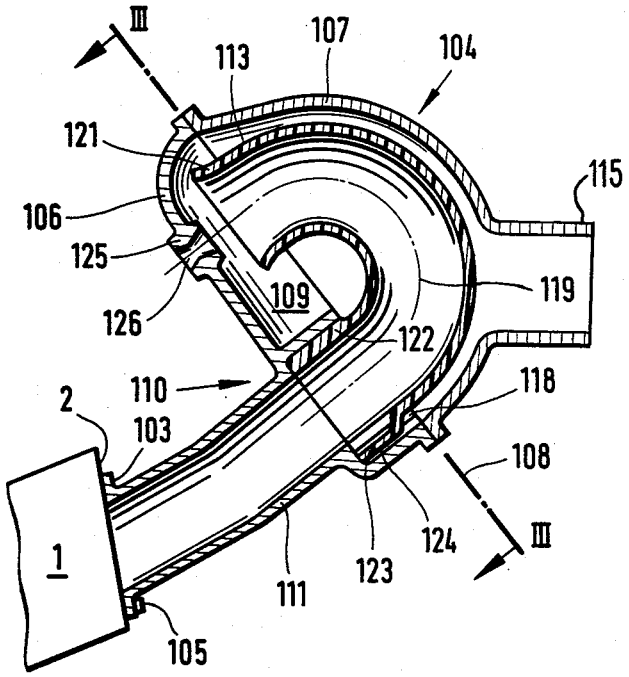
FIG. 2 shows the cross-section of an embodiment modified from that of FIG. 1, having separately constructed curved portions of induction manifolds disposed inside the distributor housing.
Figure 3:
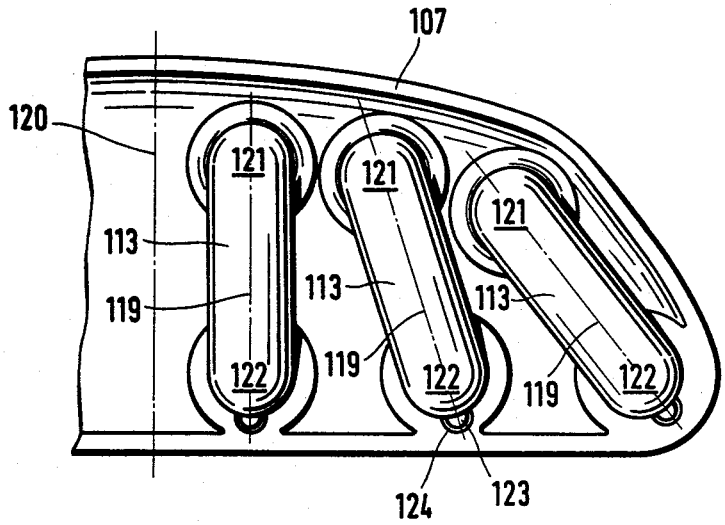
FIG. 3 is a view of a part of the two-part distributor housing with the second part removed, illustrating curved portions of induction manifolds pivoted towards the middle transverse plane of the said housing.

In the embodiment of the invention shown in FIGS. 2 and 3, there is on the face 2 of the internal combustion engine 1 an air induction system 104 which is attached by means of bolts 105, through fixing flanges 103 and which has an air inlet connection 115. A distributor housing 109 is formed by the first part 106 and the second part 107 which abut each other on a plane 108, being tightly connected by screws or by adhesive. Integrally cast on the outside of the first part 106 of the distributor housing 109 are slightly angled outer portions 111 of the induction passages 110 which form the connections to the cylinder head of the internal combustion engine 1. Disposed inside the distributor housing 109 are portions 113 of the induction passages 110 which are curved through approximately 180°. The curved portions 113 of the induction passages 110 are constructed so that they are each the same as one another. They are centred in cylindrical depressions 118 formed in the first part 106 of the distributor housing 109 and are so secured that their longitudinal axes 119 form different angles, as seen in FIG. 3, with respect to the middle transverse plane 120 of the distributor housing 109. The angles about which the curved portions 113 are inclined become greater with increasing distance from the transverse plane 120. The free ends 121 of the curved portions 113 consequently lie closer to one another and closer to the middle transverse plane 120 of the distributor housing 109 than their associated connection ends 122 which are secured in the depressions 118. Since the curved portions 113 are of equal length, their free ends 121 are at different distances from the connecting line between the connecting ends 122 which are disposed in one row. This does not result in any disadvantageous effect on the induction flow, but there is a considerable saving in space in the region of the outer free ends 121.

The connection ends 122 of the curved portions 113 are disposed at approximately right-angles to the plane 108 separating the parts of the distributor housing 109. To secure the pivoted position of the curved portions 113, they are provided with fitted keys 123 which engage into correspondingly shaped elongated grooves 124 in the depressions 118. If the curved portions 113 are made from thermoplastics material, the fitted keys 123 can be formed integrally in the moulding process. Use of thermoplastic materials does not only simplify production, but also results in a saving of weight and in improved sound deadening. The longitudinal groove 124 in each of the depressions 118 is provided at various angular positions around the periphery, so that the particular pivoted position of the curved portion 113 secured therein is determined.

Opposite the mouths of the portions 113 of the induction passages 110, into the interior of the distributor housing 109, there are integrally cast into the walls of the first part 106 fixing bosses 125 having apertures 126 to receive fuel jets (not shown). In this way, it is possible to dispense with fixing parts which would otherwise be required. Since the part 106 is formed by pressure die-casting, it is not necessary to machine the bosses 125 and apertures 126. This method of mounting can also be used independently of the curved portions 113 shown as forming part of the induction passages 110.

Figure 4:
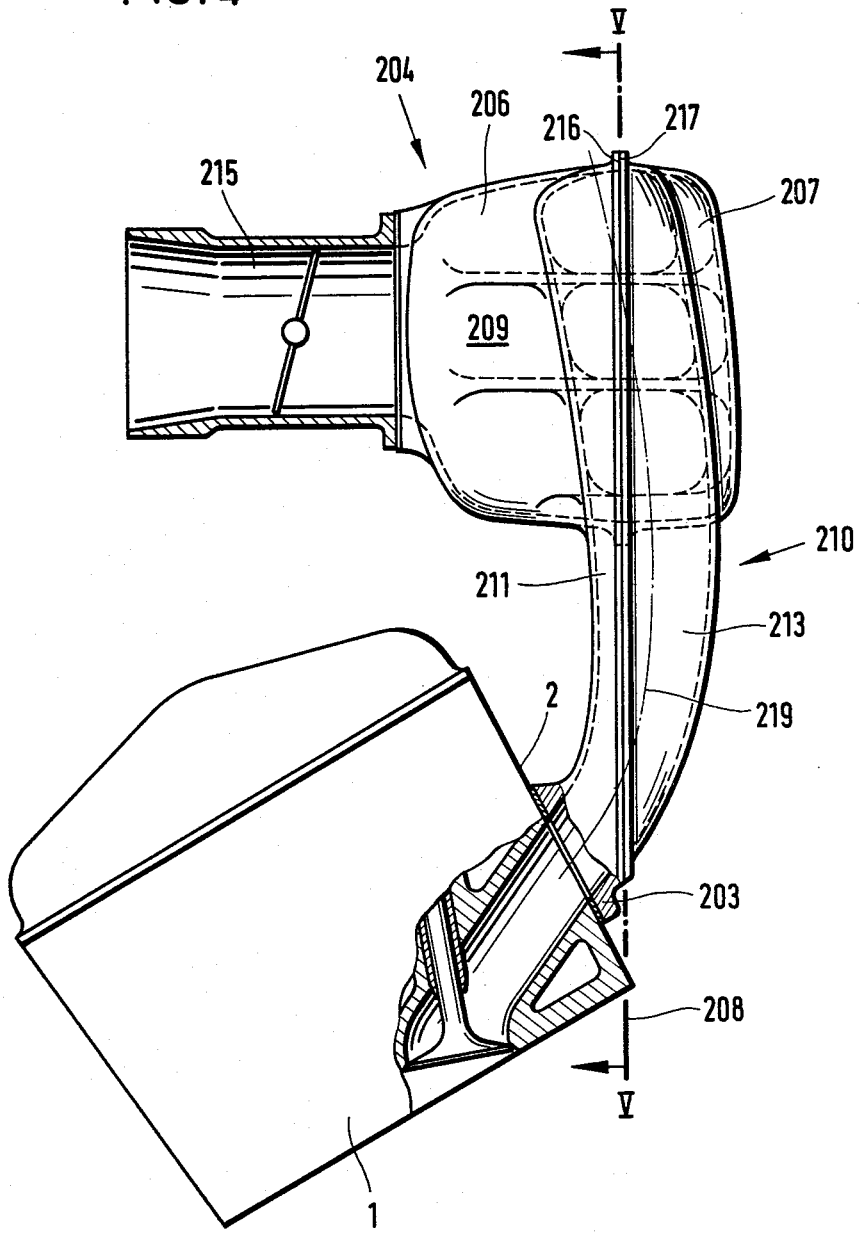
FIG. 4 is a side view of a further example of embodiment of the invention having induction manifolds integrally cast on both parts of the distributor housing and longitudinally divided in a common plane.
Figure 5:
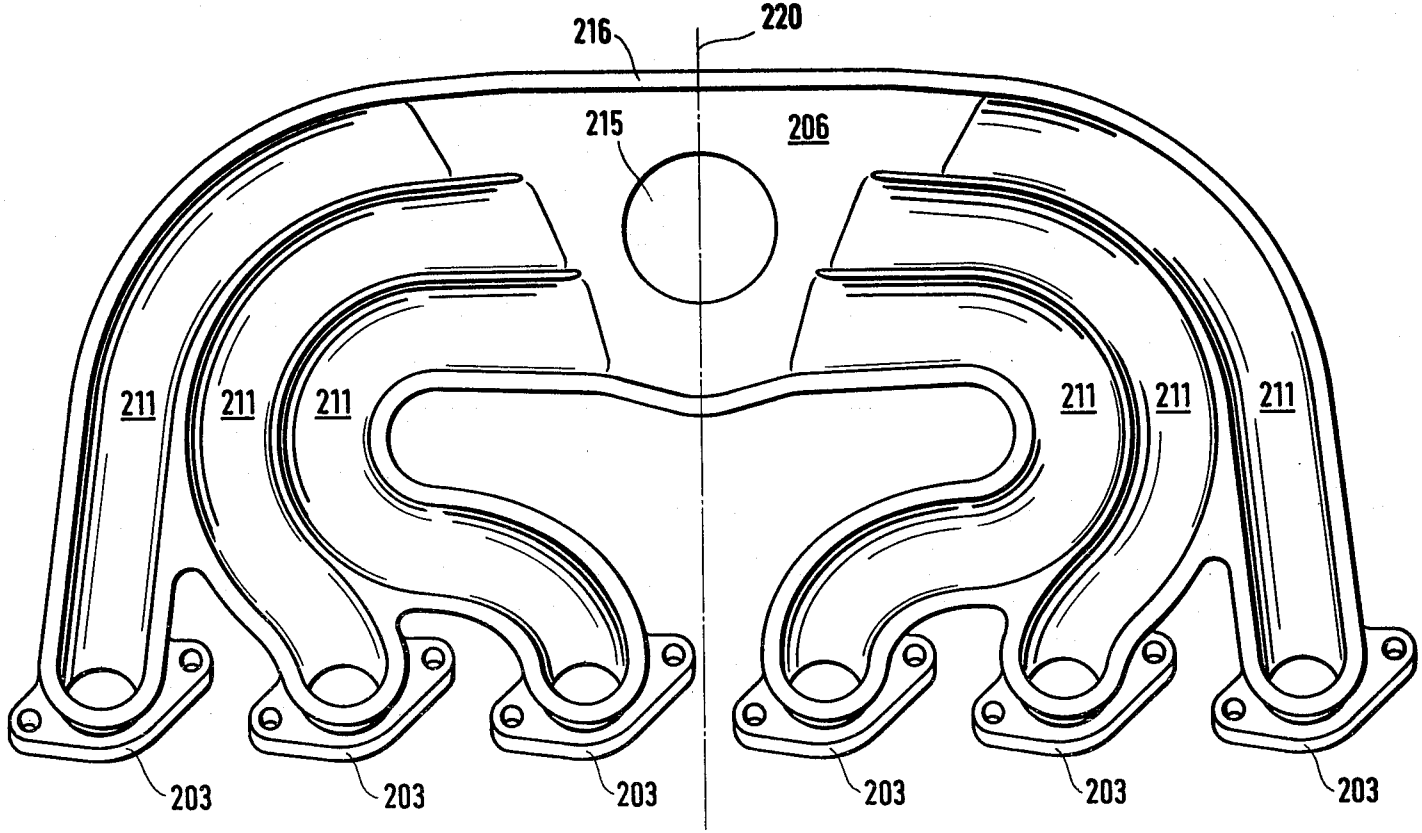
FIG. 5 is a view of a part of the two-part air induction system taken on the line V—V in FIG. 4, having portions of induction manifolds curved within the plane of the cross-section and with respect to a middle transverse plane of the distributor housing.

In the embodiment of the invention shown in FIGS. 4 and 5, the air induction system 204 consists of a two-part induction distributor housing 209, in the first and second parts 206 and 207 of which are integrally cast respectively portions 211 and 213 of longitudinally divided induction passages 210. Each portion 211 cast in the first part 206 of the distributor housing 209 lies in register with a respective portion 213 cast in the second part 207, in the plane 208 of the joint between the parts 206 and 207, both, contact faces 216 and 217, of the parts 206 and 207, connected to one another in sealing-tight fashion by adhesive or by other means of connection. To enlarge the surfaces 216 and 217, flanges are formed on the parts 206 and 207 in the region of the plane 208.

The induction passages 210 are curved towards the face 2 of the cylinder head of the internal combustion engine 1 at their end portions and are attached thereto by means of flanges 203 which are integrally formed on the portions 211. Disposed along the curved induction passages 210 is the plane 208 which, by reason of the curvature of the passages, cuts their longitudinal axes 219 at two places in each case. The plane 208 extends within the internal cross-section of the induction passages 210 which is so established that it widens out constantly towards the connecting faces 216 and 217 so that both parts of the air induction system 204 are free from re-entrant portions and can be moulded by the pressure die-casting method. The closed tubular cross-section in the region of the flanges 203 widens in the direction of the plane 208 and is thus likewise capable of being formed with no reverse taper.

In the plane of separation (FIG. 5), the induction manifolds 210 are classified in two groups which are mirror reflections of each other and which are integrally cast on both sides of the parts 206 and 207 of the distributor housing 209. They are arcuately curved from both sides to a middle transverse plane 220 of the distributor housing 209. The path lengths of the induction manifolds 210 as well as the spacings between their flanges 203 are in each case identical.

By reason of the twofold curvature, on the one hand towards the cylinder head of the internal combustion engine 1 and on the other hand in the longitudinal direction of the internal combustion engine 1, the induction passages 210 are formed with a three-dimensional curvature. The length of resonant pipe needed to tune the air induction system thus needs only very minimal space and can be accommodated at negligible installation cost, by only two pressure die-cast components.

The air induction system according to the above embodiments of the invention is ideal for rational series production. The production of at least one part of the air induction system as a one-piece pressure die-cast component which is connected to the other possibly likewise pressure die-cast or permanent mold cast part, provides in comparison with known embodiments of air induction systems, a functionally advantageous and cost-wise considerably more favourable construction.

We claim:

1. In combination, an internal combustion engine and an air induction system therefor, said air induction system having an air inlet opening, a distributor housing, and a plurality of induction passages, said induction passages having their respective inlets disposed in the distributor housing and respective outlets for connection to respective inlet ports of the engine, each induction passage consisting of a first portion and a second portion in series between the inlet and the outlet thereof, the first portion defining said inlet and the second portion defining said outlet, the distributor housing comprising a first pressure die cast part which defines said second portions of the induction passages, and a second part in which said air inlet is formed and which is joined to said first part to form said distributor housing therewith, and said indirection system further including a plurality of further parts defining the first portions of said induction passages respectively, and each of said further parts being curved and consisting of a separate member mounted on said first pressure die cast part.

2. A combination according to claim 1, wherein the second portion of each induction passage is provided with an integral flange at the outlet end thereof for mounting the induction system on a face of the engine, and the internal cross-section of the second portion widens towards one or both ends thereof.

3. A combination according to claim 1, wherein said first portions are disposed so that their ends adjacent said housing are closer together than their ends remote from said housing.

4. A combination according to claim 3, wherein said first portions are disposed symmetrically about a middle tranverse plane through said housing, at least some of said first portions extending at an angle to said transverse plane.

5. A combination according to claim 1, wherein said first portions are each of the same configuration, and a respective cylindrical depression is provided in said first part in register with the respective second portion to receive one end of each first portion.

6. A combination according to claim 5, wherein a key is provided disposed between each said first portion and its respective cylindrical depression to angularly locate the first portions therein, the keys being located in the depressions according to the required angular disposition of the first portion.

7. A combination according to claim 5, wherein said first portions are moulded from synthetic plastics material, and each have a key formed integrally therewith, a keyway being provided in the respective depression to receive that key thereby to locate the first portions in the required angular disposition.

8. A combination according to claim 1, wherein said housing is provided with fixing lugs and apertures for fuel injection nozzles associated with each said induction passage.

9. A combination according to claim 1, wherein each said first portion is mounted separately on said first part and extends within said second part, each first portion being curved through substantially 180°.

* * * * *